US005815184A

United States Patent [19]

Ujita et al.

[11] Patent Number: 5,815,184

[45] Date of Patent: Sep. 29, 1998

[54] INK CONTAINER HAVING PLURAL POROUS MEMBERS FOR STORING INK AND INK JET APPARATUS HAVING SAID INK CONTAINER

[75] Inventors: Toshihiko Ujita, Yamato; Hiroshi Sugitani, Machida; Tsuyoshi Orikasa, Musashimurayama; Osamu Sato, Kawasaki; Masahiko Higuma, Tougane; Yasuo Kotaki, Machida; Jun Hinami, Kawasaki, all of Japan

[73] Assignee: Canon Kabushiki Kaisha, Tokyo, Japan

[21] Appl. No.: 929,086

[22] Filed: Sep. 15, 1997

Related U.S. Application Data

[63] Continuation of Ser. No. 379,757, Jan. 27, 1995, abandoned.

[30] Foreign Application Priority Data

Jan. 31, 1994 [JP] Japan ..... 6-009877

[51] Int. Cl.[6] ..... B41J 2/175

[52] U.S. Cl. ..... 347/89

[58] Field of Search ..... 347/84, 85, 86, 347/87; 222/187

[56] References Cited

U.S. PATENT DOCUMENTS

| | | | |
|---|---|---|---|
| 4,063,665 | 12/1977 | Schneider et al. | 222/187 |
| 4,771,295 | 9/1988 | Baker et al. | 347/87 |
| 5,025,271 | 6/1991 | Baker et al. | 347/87 |
| 5,182,581 | 1/1993 | Kashimura et al. | 347/87 |
| 5,237,342 | 8/1993 | Saikawa et al. | 347/87 |
| 5,489,932 | 2/1996 | Ceschin et al. | 347/87 |

FOREIGN PATENT DOCUMENTS

| | | | |
|---|---|---|---|
| 0520695 | 12/1992 | European Pat. Off. | B41J 2/175 |
| 0536980 | 4/1993 | European Pat. Off. | B41J 2/175 |
| 0577439 | 1/1994 | European Pat. Off. | B41J 2/175 |
| 60-245562 | 12/1985 | Japan . | |
| 63-87242 | 4/1988 | Japan . | |
| 63-281850 | 11/1988 | Japan | B41J 3/04 |
| 2-34353 | 2/1990 | Japan . | |
| 240289 | 2/1990 | Japan | C02F 1/78 |
| 4357046 | 12/1992 | Japan . | |
| 5-463 | 1/1993 | Japan . | |
| 5-692 | 1/1993 | Japan . | |
| 5-38816 | 2/1993 | Japan . | |

*Primary Examiner*—N. Le
*Assistant Examiner*—Judy Nguyen
*Attorney, Agent, or Firm*—Fitzpatrick, Cella, Harper & Scinto

[57] ABSTRACT

An ink container for storing ink and an ink jet apparatus having such an ink container is provided. The ink container has an ink tank providing an enclosed space within an inner wall of the tank. The ink container is filled with inner and outer porous members having open pores for holding ink. The inner porous members are disposed within the enclosed space so as to only contact and press against other inner or outer porous members or both. The outer porous members are disposed within the enclosed space so as to contact and press against the inner porous members and the inner wall of the ink tank. This arrangement of inner and outer porous members within the ink container prevents an uneven compression distribution which occurs when conventional porous members are inserted into ink containers or when ink containers containing such conventional porous members suffer impacts. Further, the porous members can fill the entire ink container regardless of the shape of its interior, thus reducing the amount of non-dischargeable ink and leakage.

19 Claims, 9 Drawing Sheets

FIG. 2(a) PRIOR ART
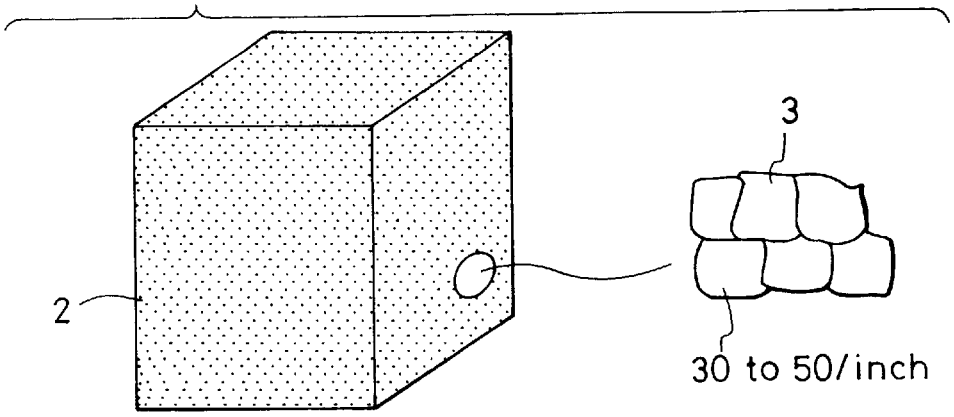
FIG. 2(b) PRIOR ART
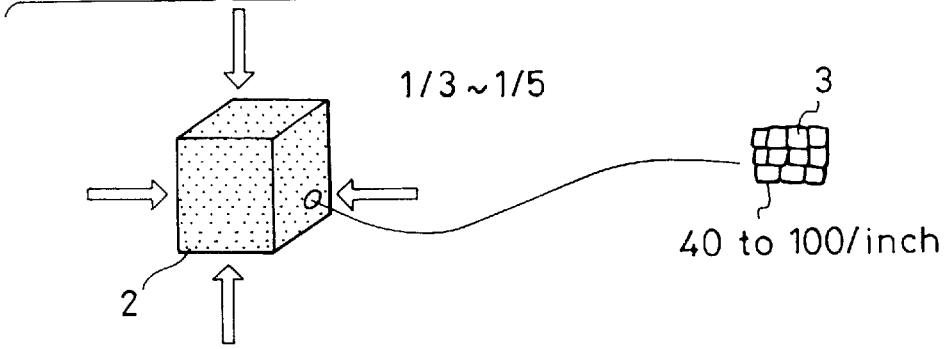
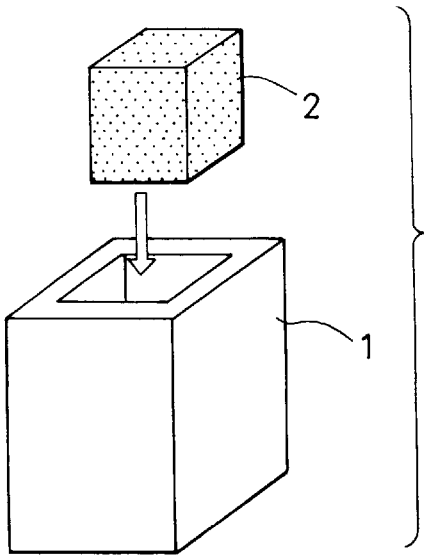
FIG. 2(c) PRIOR ART

INK CONTAINER HAVING PLURAL POROUS MEMBERS FOR STORING INK AND INK JET APPARATUS HAVING SAID INK CONTAINER

This application is a continuation of application Ser. No. 08/379,757 filed Jan. 27, 1995 abandoned.

BACKGROUND OF THE INVENTION

1. Field of the Invention

The present invention relates to an ink tank which is an ink container and, more particularly, to an ink tank serving as an ink container for storing ink used as a recording agent (liquid) in recording apparatuses, such as writing implements, ink jet recording apparatuses, copier machines, or facsimiles.

2. Description of the Related Art

In recent years, there has developed a demand for a compact liquid jet recording apparatus employing liquid ink for recording. FIG. 1 shows an example of such an apparatus IJRA having a recording unit IJC, having a recording head serving as recording means for recording on a recording medium P and an ink tank serving as a liquid storage unit, disposed on a printer carriage HC. The carriage HC scans the recording medium P in the directions a and b, and a platen PL driven by a motor transports the recording medium.

Regarding the recording unit, constructions in which the recording head and the ink tank are formed as one unit, and in which the recording head is separable from the ink tank so that only the ink tank is replaced when the ink is used up, have been proposed. When such a replaceable ink tank is used, size, and therefore the volume, of the ink tank is necessarily limited.

However, the amount of ink available to the recording means for recording information should not be limited by the size of the apparatus. Therefore, it is important to effectively use the volume available, and it is necessary that as much of the ink in the container as possible be used.

In the ink tank, a porous member, typified by a sponge, has been widely used in the past as means for holding ink. Such a porous member exerts a capillary force on the ink, and by varying the size of the pores or the compressibility of the porous member, it is possible to vary the capillary force as desired. Thus, it is possible to provide an ink holding force for holding the pressure balance required in the recording head in a wide range. As a result, a stable ink supply is assured, and also the tank construction can be simplified, making it possible to manufacture the apparatus at a relatively low cost.

There are a number of porous members which store ink by the above-described capillary force. A minimum requirement for such a member is that the internal spaces be interconnected. Also, the greater the total volume of the internal spaces of the porous member with respect to the internal volume of the structural member (that is, the ink tank) in which the porous member is housed, the greater the amount of ink which can be held and the higher the space-use efficiency of the ink tank.

In that regard, a sponge is excellent as an ink-storing porous member, because the effective porosity of a typical sponge can reach 70% or thereabouts. Resin-material sponges, in particular, are applied to wide uses, and various resin materials are commercially available. Thus, such a sponge is excellent in that the price of the material is low.

For the recording head to perform precise recording, it is necessary that the ink head pressure in the recording head be lower than the atmospheric pressure. Generally speaking, the ink head pressure is made lower by 0 to 150 mmAq than the atmospheric pressure by virtue of the ink holding force of the porous member. In practice, it is preferable that the ink head pressure be made lower than atmospheric pressure by 30 mmAq or more in order to prevent ink from leaking to the outside from the ink tank.

To achieve this pressure balance by the capillary force of the porous member, a fine capillary structure with 40 to 100 cells (pores) per inch is necessary, with the exact number depending on the type of ink stored. However, it is very difficult to make the pore size of a resin sponge that small in a conventional expansion process. A sponge of such a small porous size would have an inordinately high cost. Therefore, the necessary small-size porous member is provided in the ink tank by the method shown in FIG. 2. Initially, a porous member 2 having a typical structure in that the number of pores 3 per inch is 30 to 50/inch, as shown in FIG. 2(*a*), is compressed from 3 to 5 times (that is, the volume is decreased ⅓ to ⅕) as shown in FIG. 2(*b*). The compressed porous member is then inserted into an ink tank 1 as shown in FIG. 2(*c*), thereby providing in the ink tank a porous member with the required 40 to 100 cells/inch.

FIG. 3 is a schematic view of an ink tank into which a porous member has been compressed and inserted by the above-described method, wherein the compression state is represented in grid form. Reference numeral 1 denotes an ink tank; reference numeral 2 denotes a porous member; reference numeral 4 denotes an ink outlet for guiding the ink I stored inside the ink tank to the recording head or the like; reference numeral 5 denotes an air connection port or vent; reference numeral 6 denotes a rib for vapor-liquid replacement; and reference numeral 8 denotes an ink exit member having a tubular configuration for guiding the stored ink to the outside. At the ink exit member 8, compression of the porous member 2 is increased by pressing and deforming the porous member 2 in the vicinity of the ink outlet 4 so that the ink is concentrated and operational efficiency is improved.

If there is no local deviation in the compression gradation of the porous member when the porous member is inserted into the housing which constitutes the ink tank, the initial distribution of the ink stored inside the ink tank 1 is uniform. In this state, when the ink exit member 8 on the recording head side is inserted as shown in FIG. 3, a desirable compression gradation, in which there is no local compression concentration, is formed. Therefore, even as the amount of ink is reduced during recording, the flow of ink is not interrupted, and the ink stored inside the ink tank 1 is consumed uniformly by flowing toward the ink exit member 8 from the rest of the porous member.

However, insertion of the porous member while it is compressed takes the longest time of the ink tank manufacturing steps and requires a precisely designed assembly machine. Accordingly, the cost of the ink tank is increased. In addition, since it is difficult to uniformly compress and insert the porous member, the probability is high that a portion with a locally high compression will be formed. In such a case, ink concentrates at a portion of the porous member with a locally high compression, and thus the amount of ink which can actually be used is reduced substantially.

An experiment shows that even when sponges of the same design are inserted into the same ink tank case in the same apparatus, there is a high probability that a compression variation will occur due to slight variations in insertion speed, the occurrence of slight dimensional errors in the sponges or the way a particular sponge wrinkles when compressed. In an extreme example, there is a case in which the ink use efficiency with respect to the ink stored inside the ink tank will be less than 50% of the ink use efficiency the porous sponge member is uniformly compressed.

FIG. 4 is a schematic view of an ink tank having the same construction as that of FIG. 3, but illustrating a case in which the porous member 2 has been loaded in the ink tank 1 with local deviations in compression. Since the porous member 2 has portions, indicated by "A" in the figure, where compression is abnormally high, and the ink is undesirably concentrated, causing the ink supply passage to be interrupted and resulting in ink being unavailable for recording because it remains inside the ink tank.

FIG. 5 illustrates an example in which a conventional ink tank is subjected to an excessive impact. In such a case, the sponge inside the ink tank deviates along the direction of the impact, and as a result the compression distribution is altered. This is due to the fact that the deviation of the sponge generally does not return to its original state after the impact. Further, the ink in the sponge may also be moved by the impact or the communication between the sponge and the ink outlet may be cut.

An ink jet recording apparatus having an ink tank containing two porous members is known in the art as shown by U.S. Pat. No. 5,182,581. It is both difficult and expensive, however, to insert the two porous members into the ink tank and maintain a uniform or predetermined compression distribution because of the frictional force applied against the two porous members by the inner wall of the ink tank and/or between two porous members. Undesirable regions of high compression will occur within the porous members leading to reduced ink use efficiency. Further, the two porous members will suffer compression and ink distribution problems similar to those of a single porous member upon impact of the ink container.

SUMMARY OF THE INVENTION

The present invention has been are achieved in view of the above-described problems of the prior art. It is an object of present invention to solve the above-described problems and to realize an ink tank which is inexpensive and easy to manufacture, and is capable of supplying ink stably.

To achieve the above objects, in accordance with one aspect of the present invention, an ink container for storing ink comprises an ink tank providing an enclosed space within an inner wall of said tank, and a plurality of porous members having open pores for holding ink and including a plurality of inner porous members and a plurality of outer porous members, the inner porous members being disposed within the enclosed space so as to only contact and press against other inner porous members and/or outer porous members, and the outer porous members being disposed within the enclosed space so as to contact and press against the inner porous members and the inner wall of the ink tank.

In accordance with another aspect of the present invention, an ink jet apparatus comprises a recording head for discharging ink, the above ink container, a carriage on which the recording head and the ink container are mounted, and transport means for transporting a recording medium.

In accordance with yet another aspect of the present invention, a recording unit apparatus comprises a recording head for discharging ink and the above ink container further comprising an ink supply tube consisting of a portion projecting out of the ink tank and a portion projecting into the ink tank for supplying ink to the recording head from the ink container, wherein the recording head is integrally formed on the ink container so as to incorporate the portion of the ink supply tube projecting out of said ink tank.

The above and further objects, aspects and novel features of the invention will more fully be appreciated from the following detailed description when read in connection with the accompanying drawings. It is to be expressly understood, however, that the drawings are for the purpose of illustration only and are not intended to limit the invention.

BRIEF DESCRIPTION OF THE DRAWINGS

FIG. 2(*a*), 2(*b*) and 2(*c*) are conceptual views illustrating a step of inserting a porous member into a conventional ink tank; FIG. 2(*a*) shows a porous member in a non-compressed state; FIG. 2(*b*) shows a porous member during a compression step; and FIG. 2(*c*) shows a step of inserting the compressed porous member into an ink tank;

FIG. 6(*b*) is an enlarged view of the region X in FIG. 6(*a*); FIG. 6(*c*) is a schematic sectional view taken along the line E–E' of FIG. 6(*a*); and FIG. 6(*d*) is a schematic view illustrating the first embodiment of the present invention;

DETAILED DESCRIPTION OF THE PREFERRED EMBODIMENTS

Figure 1:
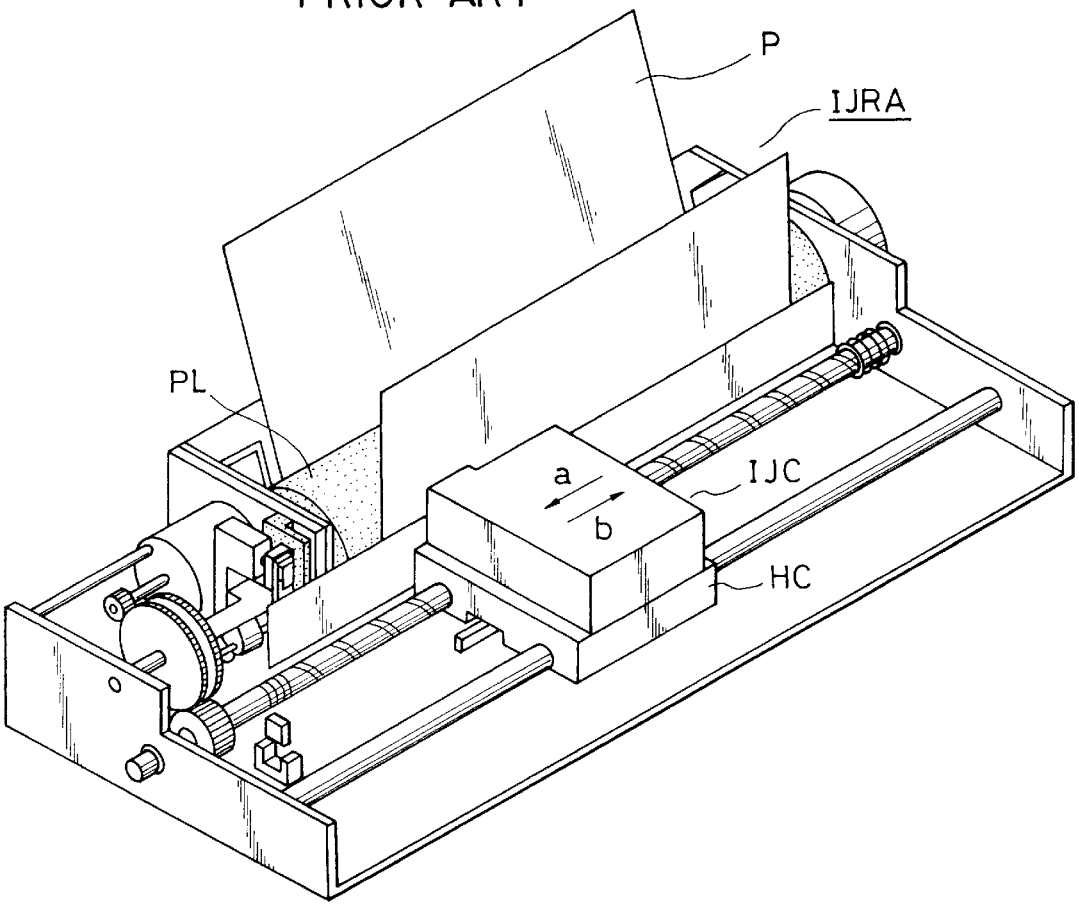
FIG. 1 PRIOR ART
FIG. 1 is a conceptual view illustrating an example of a conventional ink jet recording apparatus in which an ink tank of the present invention can be mounted.
Figure 3:
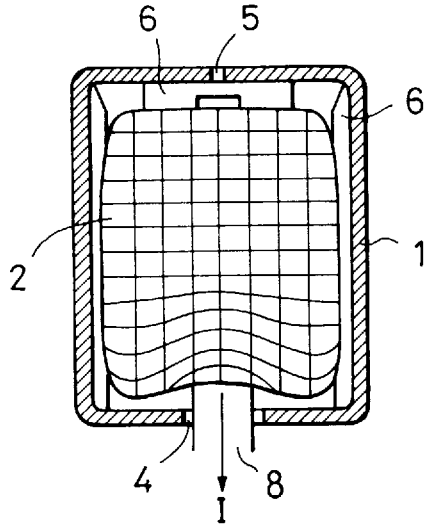
FIG. 3 PRIOR ART
FIG. 3 is a conceptual view illustrating an ideal compression distribution of the porous member inside the ink tank when a conventional single porous member is inserted into the ink tank.
Figure 4:
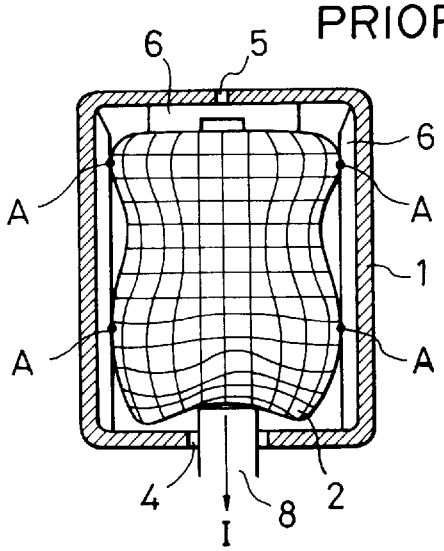
FIG. 4 PRIOR ART
FIG. 4 a conceptual view illustrating the normal compression distribution of the porous member inside the ink tank when a conventional single porous member is inserted into the ink tank.
Figure 5:
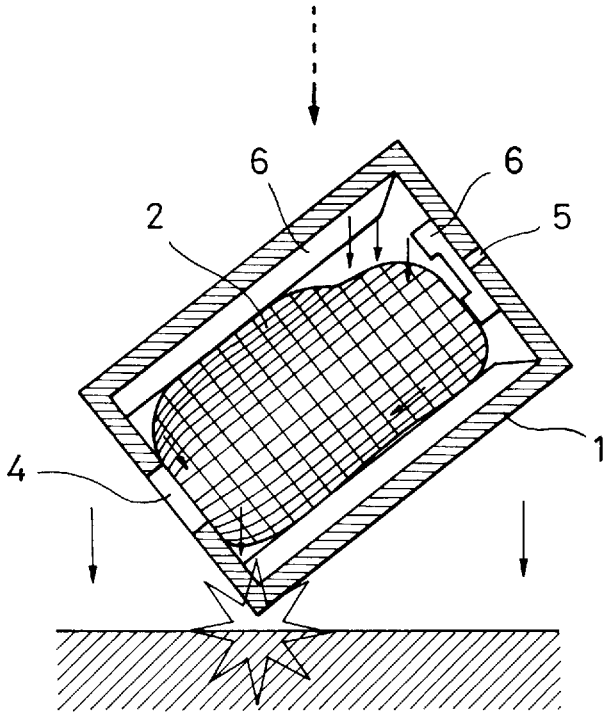
FIG. 5 PRIOR ART
FIG. 5 is a conceptual view of a state in which the porous member is filled inside the ink tank when the ink tank using a conventional single porous member receives an impact.
Figure 6A:
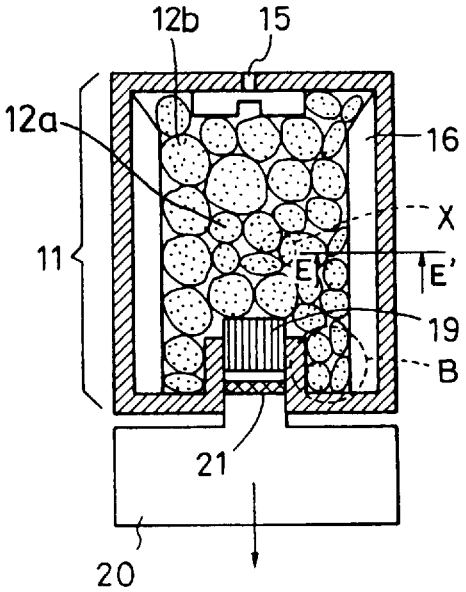
FIG. 6(*a*) is a conceptual view illustrating a first embodiment of the present invention.
Figure 6B:
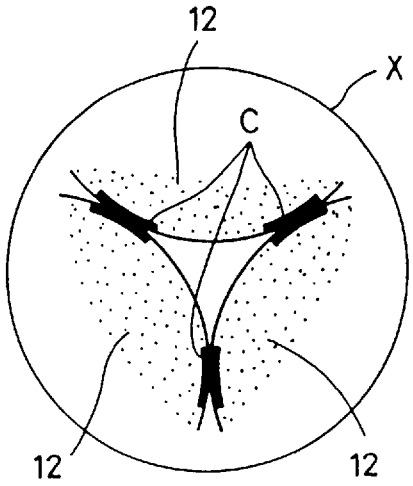
Figure 6C:
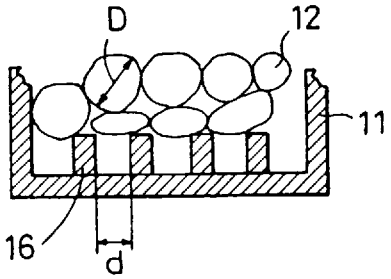
Figure 6D:
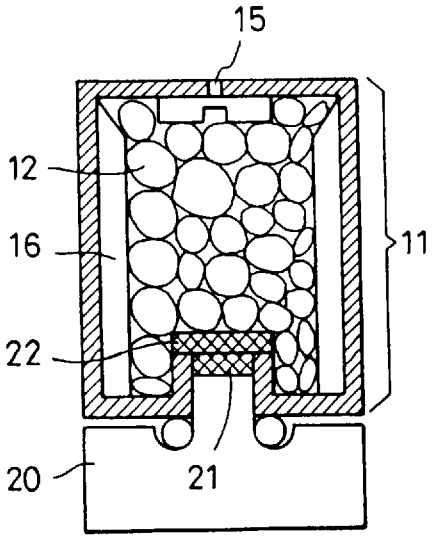
Figure 7A:
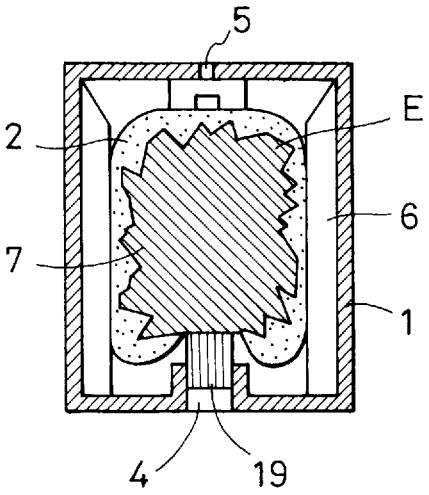
FIG. 7(a) PRIOR ART
FIGS. 7(*a*) to 7(*d*) are schematic views in which the internal ink distribution of an ink tank of the present invention and of a conventional are compared.
Figure 7B:
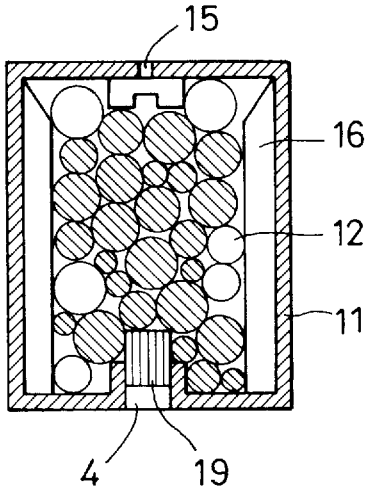
Figure 7C:
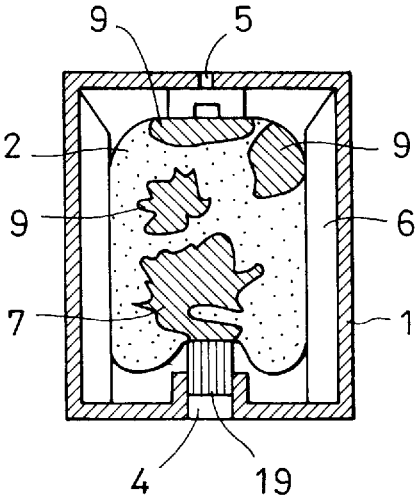
FIG. 7(c) PRIOR ART
Figure 7D:
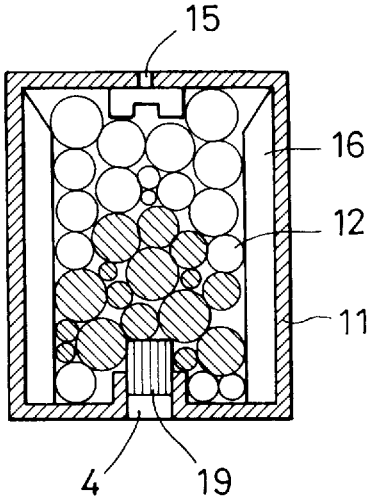
Figure 8A:
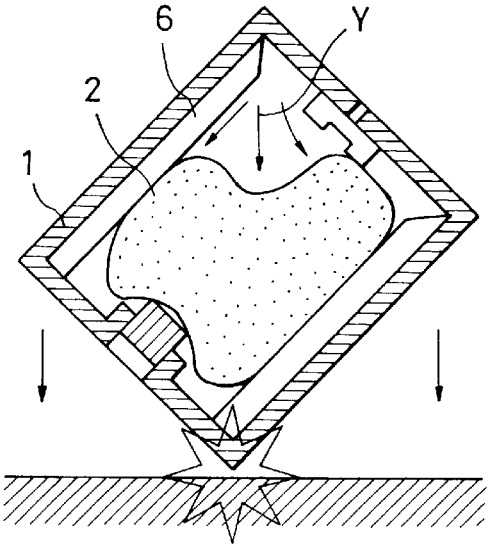
FIG. 8(a) PRIOR ART
FIGS. 8(*a*) to 8(*d*) are schematic views illustrating the internal behavior before and after impact of a porous member arrangement in an ink tank of the present invention and a porous member a conventional ink tank.
Figure 8B:
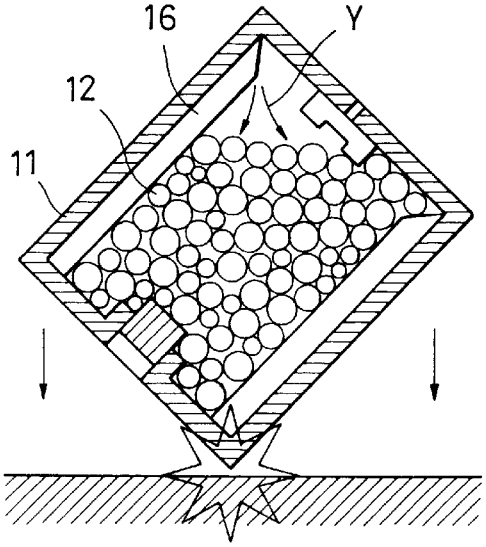
Figure 8C:
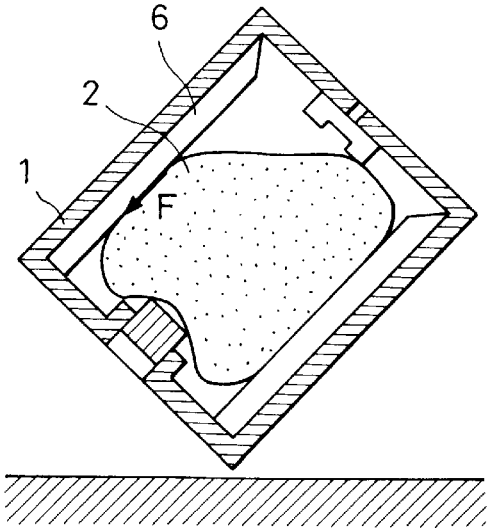
FIG. 8(c) PRIOR ART
Figure 8D:
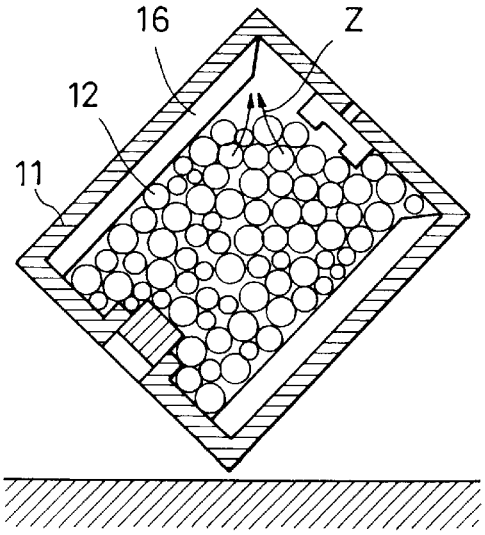

Preferred embodiments of the present invention will be explained below in detail with reference to the accompanying drawings.

[First Embodiment]

The first embodiment of the present invention is shown in FIGS. 6(*a*) to 6(*d*). In this embodiment, a replaceable type ink tank is used as an ink housing section for housing porous members. Referring to FIG. 6(*a*), reference numeral 11 denotes an ink tank serving as an ink container, and reference numeral 20 denotes an ink jet recording head which is separable from the ink tank. A press-contact member 19 is provided inside the ink tank 11. The press-contact member 19 forms an ink passage by a capillary force created as a result of closely contacting a filter 21 disposed in the ink outlet in the shape of a tunnel of the ink jet recording head 20. In this example, a member having fine fiber bundles is used.

Reference numeral 12 denotes a porous member which is formed to be small in comparison with the internal volume of the ink tank. A plurality of porous members 12 are provided inside the ink tank, and fill the ink container so as to press against each other. Porous members 12 include a plurality of inner porous members 12*a* and a plurality of outer porous members 12*b*. Inner porous member 12*a* disposed in the central portion of the inside of the ink tank only contacts and presses against other porous members, and outer porous member 12 *b* disposed in the vicinity of the inner wall of the ink tank contacts and presses against both the other porous members and the inner wall of the ink tank.

The size and shape of the porous members 12 are preferably such that a plurality of them can press against all the inner walls of the ink tank. Hereinafter, the porous members 12 will be referred to as sponge cells or flake porous members.

The ink tank has an air induction port 15 for inducting air into the interior of the container from the outside. The pressure of the interface of the sponge cell 12 with the air is equal to the atmospheric pressure. If the sponge cell 12 is sufficiently small, it is possible to fill the intricate place (the B region in FIG. 6(*a*)) inside the ink tank 11 with the porous members without leaving a vacancy which will otherwise be formed when a single porous member is inserted into the ink tank. As shown in FIG. 6(*a*), the sponge cells are sufficiently small when compressed that their minimum width is less than the inner diameter of the ink outlet. Therefore, since the ink can be held by the porous members without forming a vacancy inside an ink tank having a desired internal shape, it is possible to effectively prevent ink leakage which occurs as a result of the ink remaining in said vacancy.

Since each sponge cell is independent in structure, it receives a compression force nearly uniformly, and the capillary force of each sponge cell is also uniform. When seen microscopically, the boundary (the C region in the figure) in which the sponge cells 12 are brought into press contact with each other as shown in FIG. 6(*b*) is where the compression force concentrates, and the capillary force is high. When the above is considered from the viewpoint of ink supply, it can be assumed that small porous members are uniformly impregnated with the ink, and there is no problem from a point of view of performance. When considered from this viewpoint, a more preferable embodiment is to make the size and shape of the porous members the same so as to make the ink distribution more uniform.

As a result of the press-contact member 19 being in close contact with the plurality of sponge cells 12, the passage of the ink to the outside is assured. In such a case, if the capillary force of the sponge cell 12 in the vicinity of the press contact member 19 is adjusted by putting pressure on the ink outlet tube on the ink jet recording head 20 side so that the capillary force becomes greater than that of the sponge cell 12 on the other side, the ink use efficiency is improved further. However, the capillary force of the sponge cell 12 must not be greater than that of the pressure contact member 19 and is designed to achieve this relationship.

In this embodiment, instead of the press contact member 19, a member or a structure causing a sufficient capillary force as shown in FIG. 6(*d*) (for example, a filter 22 is pressed against the sponge cell 12) may be used.

An air passage which is directly connected to the air induction port 15 is formed to sufficiently induct the outside air to each sponge cell 12 so as to achieve stable ink supply. In this embodiment, an air passage is secured by forming a plurality of rows of ribs 16 integrally on the inner wall of the ink tank. As described above, since the sponge cells 12 are loaded in a state in which the sponge cells 12 are compressed with each other inside the ink container regardless of the shape of the interior of the ink tank 11, if the porous member is extremely small, a porous member may enter between adjacent ribs 16.

Even if the minimum width of the sponge cell 12 is small when it is compressed, it is possible to secure an air passage between the ribs 16 and the sponge cell 12 by an arrangement of said sponge cells. However, to form the air passage more reliably, it is preferable that the passage width "d" formed between the ribs 16 be set smaller than the size D, the smallest diameter portion of a compressed sponge cell, as shown in FIG. 6(*c*).

With reference to FIG. 7, the comparison of the ink distribution as a result of using the ink in the ink tank of the first embodiment with that in a conventional tank will be explained. FIGS. 7(*a*) and 7(*c*) are schematic views illustrating the ink distribution inside the conventional ink tank. FIGS. 7(*b*) and 7(*d*) are schematic views illustrating the ink distribution inside the ink tank of this embodiment.

FIGS. 7(*a*) and 7(*b*) each illustrate the initial state in which ink is sufficiently stored inside the ink tank. As shown in FIG. 7(*a*), when a single porous member is used, the capillary force of the porous member occurs in the interface (E in the figure) between the ink 7 which is distributed inside the single porous member 2 and the outside air.

The ink interface E is formed naturally in such a way that the capillary force of each interface becomes equivalent. At this time, in case that an ink tank using the conventional single porous member 2 is used, since the compression distribution becomes nonuniform inside the porous member 2 as described above, the ink interface becomes intricate. However, a problem, as a result of this intricateness, is not posed when the amount of ink is great as shown in FIG. 7(*a*).

On the other hand, since the capillary forces of each of the sponge cells 12 are nearly equal in the ink tank of the embodiment shown in FIG. 7(*b*), the ink interface is formed in a desired shape.

FIGS. 7(*c*) and 7(*d*) illustrate a state in which the ink is partially consumed. FIG. 7(*c*) shows the ink distribution when a single porous member is used. When the compression of the porous member 2 is unevenly distributed, the ink concentrates in a portion of the porous member having a high compression. Therefore, when the amount of ink is reduced by the consumption of ink, the ink supply passage is likely to be interrupted, and as a result the ink remains in the portion with the high compression.

The remaining ink 9 cannot be connected to ink 7 which can be guided out to the outside. Thus, it becomes impossible to supply ink to the recording head, and the ink tank 1 must be replaced.

On the other hand, in the ink tank of this embodiment filled with porous members 12 as shown in FIG. 7(*b*) and FIG. 7(*d*), there is no local increase in the compression, and the ink distribution inside the ink tank is uniform. Therefore, unlike an above-mentioned case in which some ink remains inside the container as it is consumed, the ink supply passage in this embodiment is not interrupted, and a high ink use efficiency is assured.

Next, the behavior of a case in which the ink tank of this embodiment receives an impact will be explained in comparison with the case of a conventional ink container with reference to FIG. 8. FIGS. 8(*a*) and 8(*c*) show the state of the single porous member filled inside the conventional ink tank. FIGS. 8(*b*) and 8(*d*) show the state of the porous member filled inside the ink tank of this embodiment.

As shown in FIGS. 8(*a*) and 8(*b*), when an external force is applied to each ink tank in the initial state in the downward direction in the figure by an impact caused by a drop, the porous member or members which contain ink receive a force instantaneously along the impact direction (the Y direction indicated by the arrow in the figure) in the conventional ink tank 1 and the ink tank 11 of the present invention, respectively. At this time, the porous member or members are separated from the inner wall positioned in a direction opposite to the outer wall of the ink tank which has received the impact.

Next, FIGS. 8(*c*) and 8(*d*) show the state of each porous member or members inside the ink tank after the external force has been received. As shown in FIG. 8(*c*), the position of single porous member 2 does not easily return to its original position because a high frictional force that now occurs between the inner wall of the ink tank and the entire surface of the porous member 2 facing the inner wall as indicated, for example, by the arrow F in the figure.

On the other hand, in the ink tank of the present invention, since the porous member inside the ink tank comprises plural porous members, inner porous members inward of outer porous members contacting the inner wall do not experience the high frictional force along the inner wall, and are thus easily movable and able to instantly fill the space formed on impact.

Further, there is a high probability that the ink is unevenly distributed due to the impact when a conventional single porous member is used. However, since use of the ink tank of the construction shown in this embodiment causes the small porous members 12 impregnated with ink to move, the ink distribution is returned to the evenly distributed initial state.

[Second Embodiment]

Figure 9:
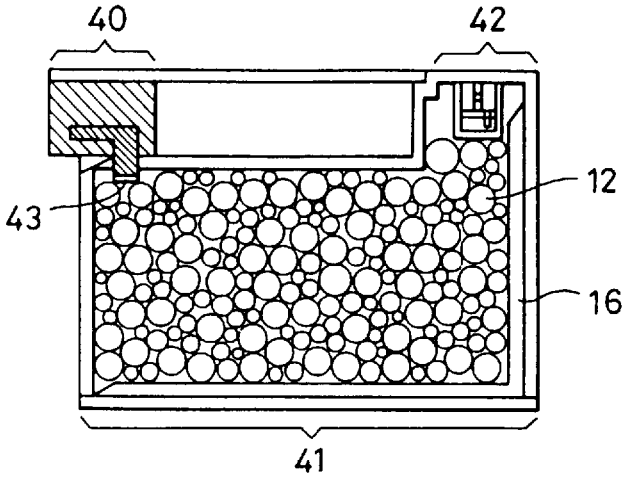
FIG. 9 is a schematic view illustrating a second embodiment of an tank of the present invention.

FIG. 9 shows a case in which the above-described sponge cell 12 is used in the recording unit in which the recording head and the ink tank serving as an ink container are formed as one unit. Reference numeral 40 denotes a recording head; reference numeral 41 denotes an ink tank; reference numeral 42 denotes an air induction port; and reference numeral 16 denotes a rib for vapor-liquid replacement. Also in this embodiment, an ink supply tube 43 for supplying ink to the recording head protrudes into the ink tank 41, and a compression gradient is formed to promote the supply of ink to the recording head.

Also in this embodiment, since the sponge cells 12 fill the inside of the ink tank in the same way as in the first embodiment, no local deviation of compression occurs in the porous member, and there is no influence upon the ink distribution due to an external impact.

[Third Embodiment]

Figure 10:
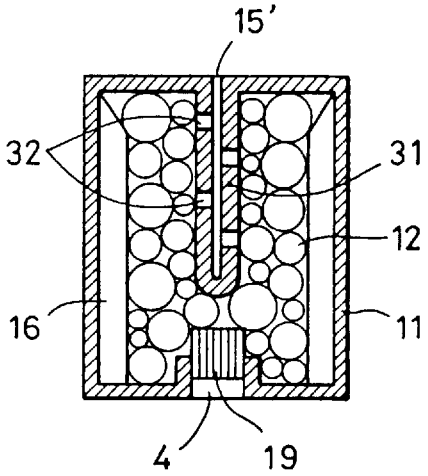
FIG. 10 is a schematic view illustrating another embodiment of an ink tank of the present invention.

FIG. 10 shows a third embodiment of the present invention.

Although in the above-described embodiment an air passage is secured by using a rib disposed on the inner wall of the ink tank, an air induction port 31 is disposed to supply ink more stably in this embodiment so that air can be easily introduced to a central portion of the ink tank. The air induction port 31 is formed with an external opening 15', a plurality of internal openings 32, and air can be supplied to the sponge cell inside the ink tank more reliably. Thus, it becomes easier to introduce air into the ink tank as the ink is consumed in comparison with the case in which air is introduced only in the vicinity of the inner wall of the ink tank, which prevents the amount of ink supply from varying.

In addition, since the probability that the air passage clogs is reduced in comparison with the case of rib-only construction, the replacement between the ink and the air in the sponge cells 12 is performed without resistance over the entire ink tank, and it becomes possible to smoothly supply ink to the ink jet recording apparatus. Thus, the ink use efficiency can be improved even further.

[Other Embodiments]

Although the shape of the sponge cell is nearly spherical in each of the above-described embodiments, the shape need not be limited to this shape. Another example of the porous members which are usable for the present invention is shown in FIGS. 11(*a*) and 11(*b*).

Figure 11A:
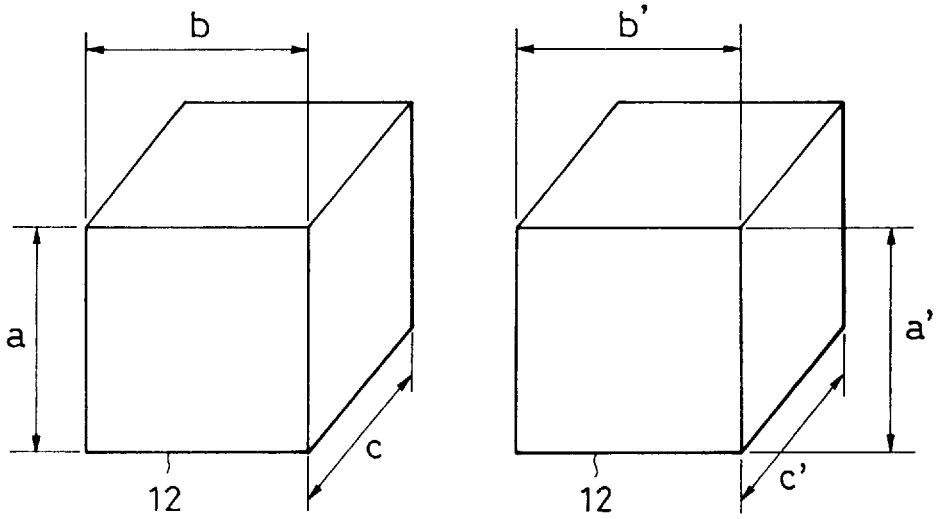
FIGS. 11(*a*) and 11(*b*) are schematic views illustrating examples of porous members for use inside ink tanks of the present invention.
Figure 11B:
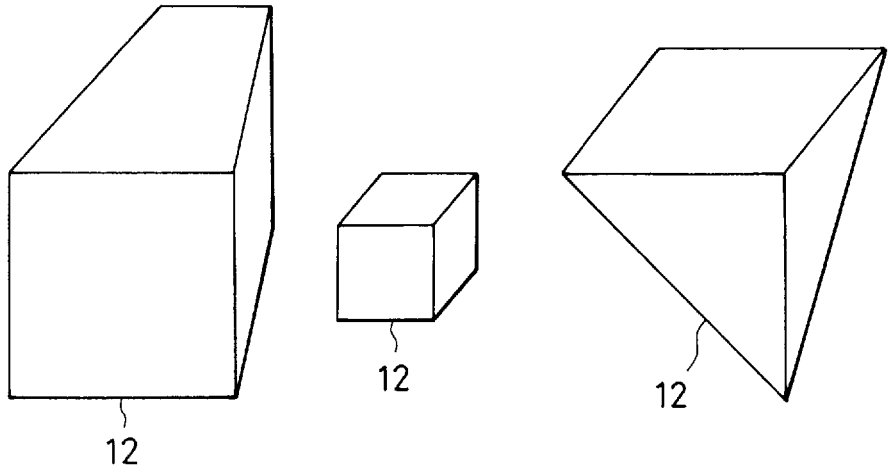

FIG. 11(*a*) illustrates examples of sponge cells 12 which are formed in the shape of a rectangular parallelepiped. In FIG. 11(*a*), the lengths of the respective sides of the porous member a, b, c and a', b', c' are approximately equal, although this need not be required. However, size standardization that is, making the porous members substantially equal in size achieved by making the lengths nearly equal makes it easier to manufacture the sponge cells as when they have a spherical shape, and performance is more stable. Also, size standardization is effective for making the ink distribution inside the ink tank uniform as described above.

Further, as shown in FIG. 11(*b*), sponge cells 12 of shapes other than spherical or rectangular parallelepiped may also be used. The sponge cells 12 may be randomly shaped. In such a case, the size and the material of each sponge cell is preferably the same. When the sponge cells are manufactured from a large single-piece porous member, it is possible for them to take the shape of the single-piece porous member. However, by allowing the sponge cells to take shapes as shown in FIG. 11(*b*) different from the shape of the large single-piece porous member, it is also possible to use up the entire single-piece porous member during manufacture. It is also possible to manufacture the sponge cells after a porous member of another shape has been first cut out from the single-piece porous member. Therefore, it is possible to reduce the manufacturing cost when the ink tank is manufactured over that of a conventional ink tank with a large single-piece porous member with more stringent size and shape constraints.

The present invention is suitably used in an ink tank of an ink jet recording apparatus. In addition to this example, the present invention can also be used as a liquid container for holding liquid, for example, a container for holding textile-printing ink used in what is commonly called textile printing for printing an image or the like on cloths rather than printing paper.

As is clear from the above description, the present invention makes it possible to fill the ink tank with porous members regardless of the shape of the interior of the ink tank, and the ink can be held by the porous members without creating a vacancy. Thus, it is possible to effectively prevent the ink from leaking due to the fact that the ink remains in the vacancy.

The compression distribution of the porous members inside the ink tank can be made uniform, or can be made to have a desired predetermined compression gradient. Accordingly there is no portion having an undesirable locally high compression, the ink supply passage is not interrupted, and high ink use efficiency can be assured.

In addition, even if an external force is caused by an impact to the ink tank, the porous members can easily recover to their initial state even if a vacancy is formed since the degree of freedom of movement of the porous members inside the ink tank is high. Therefore, the ink distribution is also returned to the initial state, and ink use efficiency can be maintained at a high level.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. An ink container for storing ink, said ink container comprising:

an ink tank having walls providing an enclosed space within an interior of said ink tank, said ink tank having an air induction port for introducing air into said ink tank and an ink outlet remote from said air induction port for guiding the ink out of said ink tank; and a plurality of porous members having open pores for holding the ink and including a plurality of inner members and a plurality of outer members, said porous members compressed within said ink tank, wherein each of said porous members has a minimum width less than an inner diameter of said ink outlet, and said inner members are disposed within the enclosed space so that each of said inner members contacts and presses against only other said porous members, and said outer members are disposed within the enclosed space so as to contact and press against said inner members and an interior surface of at least one wall of the ink tank in a lateral direction, the lateral direction being perpendicular to that of gravity.

2. An ink container according to claim 1, wherein said interior surface of said at least one wall of said ink tank has a plurality of ribs formed integrally thereon and extending inward to the enclosed space, and each of said porous members has a minimum width greater than a spacing between any two consecutive ribs of said plurality of ribs.

3. An ink container according to claim 1, wherein said air induction port projects into said ink tank and has a plurality of openings inside the ink tank for communicating air to said porous members.

4. An ink container according to claim 1, wherein said ink outlet projects into said ink tank.

5. An ink container according to claim 1, wherein said ink outlet contains a press-contact member for contacting and pressing against said porous members.

6. An ink container according to claim 5, wherein said press-contact member is a sponge.

7. An ink container according to claim 1, wherein said porous members are substantially equal in size.

8. An ink container according to claim 1, wherein said porous members are substantially spherical in shape.

9. An ink container according to claim 1, wherein said porous members are substantially rectangular parallelepiped in shape.

10. An ink container according to claim 1, wherein each of said porous members is randomly shaped.

11. An ink container according to claim 1, wherein said porous members are substantially equal in compression.

12. An ink container according to claim 1, wherein compressions of said porous members vary according to a predetermined compression gradient.

13. An ink container according to claim 1, wherein due to the compression of the porous members, relative positions of the porous members are not substantially altered by movement of said ink container.

14. A recording unit apparatus comprising:

a recording head for discharging ink;

an ink container for storing and supplying ink to said recording head, said ink container comprising an ink tank having walls providing an enclosed space within an interior of said ink tank, said ink tank having an air induction port for introducing air into said ink tank and an ink outlet remote from said air induction port for guiding the ink out of said ink tank; and an ink supply tube for supplying ink to said recording head from said ink container, said ink supply tube consisting of a portion projecting out of said ink tank and connecting to said recording head and a portion projecting into said ink tank, wherein said ink container further comprises a plurality of porous members having open pores for holding the ink, said plurality of porous members including a plurality of inner members and a plurality of outer members, said porous members compressed within said ink tank, each of said porous members having a minimum width less than an inner diameter of said ink outlet, said inner members disposed within the enclosed space so that each of said inner members contacts and presses against only other said porous members, and said outer members disposed within the enclosed space so as to contact and press against said inner members and an interior surface of at least one wall of the ink tank in a lateral direction, the lateral direction being perpendicular to that of gravity, said recording head integrally formed on said ink container so as to incorporate said portion of said ink supply tube projecting out of said ink tank.

15. A recording unit apparatus according to claim 14, wherein said interior surface of said at least one wall of said ink tank of said ink container has a plurality of ribs formed integrally thereon and extending inward to the enclosed space, and each of said porous members has a minimum width greater than a spacing between any two consecutive ribs of said plurality of ribs.

16. A recording unit apparatus according to claim 14, wherein due to the compression of the porous members, relative positions of the porous members are not substantially altered by movement of said ink container.

17. An ink jet apparatus comprising:

a recording head for discharging ink;

an ink container for storing ink to be supplied to said recording head, said ink container comprising an ink tank having walls providing an enclosed space within an interior of said ink tank, said ink tank having an air induction port for introducing air into said ink tank and an ink outlet remote from said air induction port for guiding the ink out of said ink tank and a plurality of porous members having open pores for holding ink, said plurality of porous members including a plurality of inner members and a plurality of outer members, said porous members compressed within said ink tank, each of said porous members having a minimum width less than an inner diameter of said ink outlet, said inner members disposed within the enclosed space so that each of said inner members contacts and presses against only other said porous members, and said outer members disposed within the enclosed space so as to contact and press against said inner members and an interior surface of at least one wall of the ink tank in a lateral direction, the lateral direction being perpendicular to that of gravity; and a carriage on which said recording head and said ink container are mounted.

18. An ink jet apparatus according to claim 17, wherein said interior surface of said wall of said ink tank of said ink container has a plurality of ribs formed integrally thereon and extending inward to the enclosed space, and each of said porous members has a minimum width greater than a spacing between any two consecutive ribs of said plurality of ribs.

19. An ink jet apparatus according to claim 17, wherein due to the compression of the porous members, relative positions of the porous members are not substantially altered by movement of said ink container.

* * * * *